US007997927B2

(12) United States Patent
Wan et al.

(10) Patent No.: US 7,997,927 B2
(45) Date of Patent: Aug. 16, 2011

(54) DUAL SOCKET CONNECTOR

(75) Inventors: Wei Wan, Hsin-Tien (TW); Shu-Lin Duan, Hsin-Tien (TW); Ching-Tien Chen, Hsin-Tien (TW); Pin-Yuan Hou, Hsin-Tien (TW); Wen-Chih Ko, Hsin-Tien (TW)

(73) Assignee: Advanced Connectek Inc., Hsin-Tien (TW)

( * ) Notice: Subject to any disclaimer, the term of this patent is extended or adjusted under 35 U.S.C. 154(b) by 0 days.

(21) Appl. No.: 12/614,796

(22) Filed: Nov. 9, 2009

(65) Prior Publication Data

US 2011/0065324 A1 Mar. 17, 2011

(30) Foreign Application Priority Data

Sep. 16, 2009 (TW) ..... 98217061 U

(51) Int. Cl.
*H01R 13/60* (2006.01)

(52) U.S. Cl. ..... 439/541.5; 439/607.23

(58) Field of Classification Search ..... 439/541.5, 439/660, 607.23, 607.32
See application file for complete search history.

(56) References Cited

U.S. PATENT DOCUMENTS

| | | | | |
|---|---|---|---|---|
| 7,588,458 | B2 * | 9/2009 | He et al. | 439/541.5 |
| 7,604,490 | B2 * | 10/2009 | Chen et al. | 439/79 |
| 7,651,371 | B2 * | 1/2010 | Yi et al. | 439/541.5 |
| 7,731,535 | B1 * | 6/2010 | Wan et al. | 439/607.4 |
| 7,758,380 | B2 * | 7/2010 | Wang et al. | 439/607.23 |
| 2004/0229502 | A1 * | 11/2004 | Hu et al. | 439/541.5 |
| 2006/0183371 | A1 * | 8/2006 | Tsai | 439/541.5 |

* cited by examiner

*Primary Examiner* — Hien Vu
(74) *Attorney, Agent, or Firm* — C. G. Mersereau; Nikolai & Mersereau, P.A.

(57) ABSTRACT

A dual socket connector has an insulative housing assembly, multiple first terminals, multiple second terminals, multiple third terminals and a shell. The insulative housing assembly has a top tongue, a bottom tongue and a partition formed between the top and bottom tongues. The first terminals are mounted on one of the top and bottom tongues for USB 2.0 signal transmission. The second and third terminals are mounted on the other tongue for USB 3.0 signal transmission. The shell covers the insulative housing assembly and defines upper and lower socket holes with the partition for engaging different plug connectors. The dual socket connector is compact and has high compatibility.

14 Claims, 10 Drawing Sheets

DUAL SOCKET CONNECTOR

BACKGROUND OF THE INVENTION

1. Field of the Invention

The present invention relates to a connector, and more particularly to a dual socket connector that is capable of simultaneously connecting to two plug connectors and occupies a substantially identical surface area of a printed circuit board (PCB) as a single conventional socket connector.

2. Description of Related Art

Conventional Universal Serial Bus (USB) 2.0 connectors are used in various electronic devices. However, USB 2.0 protocol only allows a maximum transmission speed of 480 Mbps. Because electronic devices are constantly developed to increase transmission speeds, the USB 2.0 protocol does not meet current transmission speed requirements for new electronic devices. Therefore, the USB Implementers Forum (USB IF) established USB 3.0 protocol, with a theoretical maximum transmission speed of 5 Gbps that allows more internal devices or interface cards of computers to change to external devices.

However, a USB 3.0 connector is structurally complicated so manufacturing costs are higher than other conventional connectors, such as USB 2.0 connectors. Also, PCBs, such as motherboards, may require both USB 3.0 and 2.0 socket connectors instead of USB 3.0 socket connectors entirely replacing USB 2.0 socket connectors. However, simultaneously mounting different USB 2.0 and 3.0 socket connectors on a PCB complicates a PCB layout, may reduce available mounting surface area on the PCB and complicates arrangement and selection of other electronic components mounted on the PCB.

To overcome the shortcomings, the present invention provides a dual socket connector to mitigate or obviate the aforementioned problems.

SUMMARY OF THE INVENTION

The main objective of the invention is to provide a dual socket connector that is capable of simultaneously connecting to two plug connectors and occupies a substantially identical surface area of a PCB as a conventional socket connector.

The dual socket connector in accordance with the present invention has an insulative housing assembly, multiple first terminals, multiple second terminals, multiple third terminals and a shell. The insulative housing assembly has a top tongue, a bottom tongue and a partition formed between the top and bottom tongues. The first terminals are mounted on one of the top and bottom tongues for USB 2.0 signal transmission. The second and third terminals are mounted on the other tongue for USB 3.0 signal transmission. The shell covers the insulative housing assembly and defines upper and lower socket holes with the partition for engaging different plug connectors.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
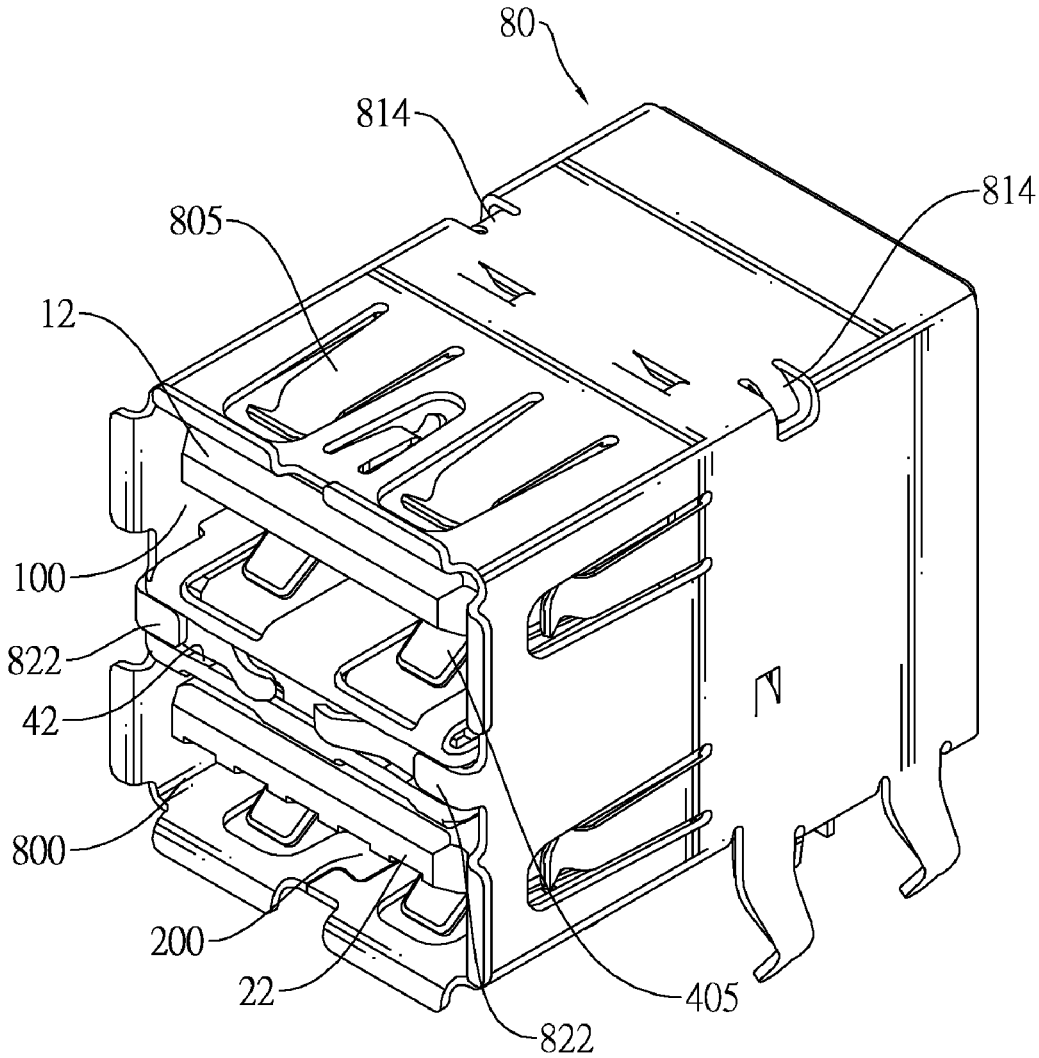
FIG. 1 is a perspective view of a first embodiment of a dual socket connector in accordance with the present application.
Figure 2:
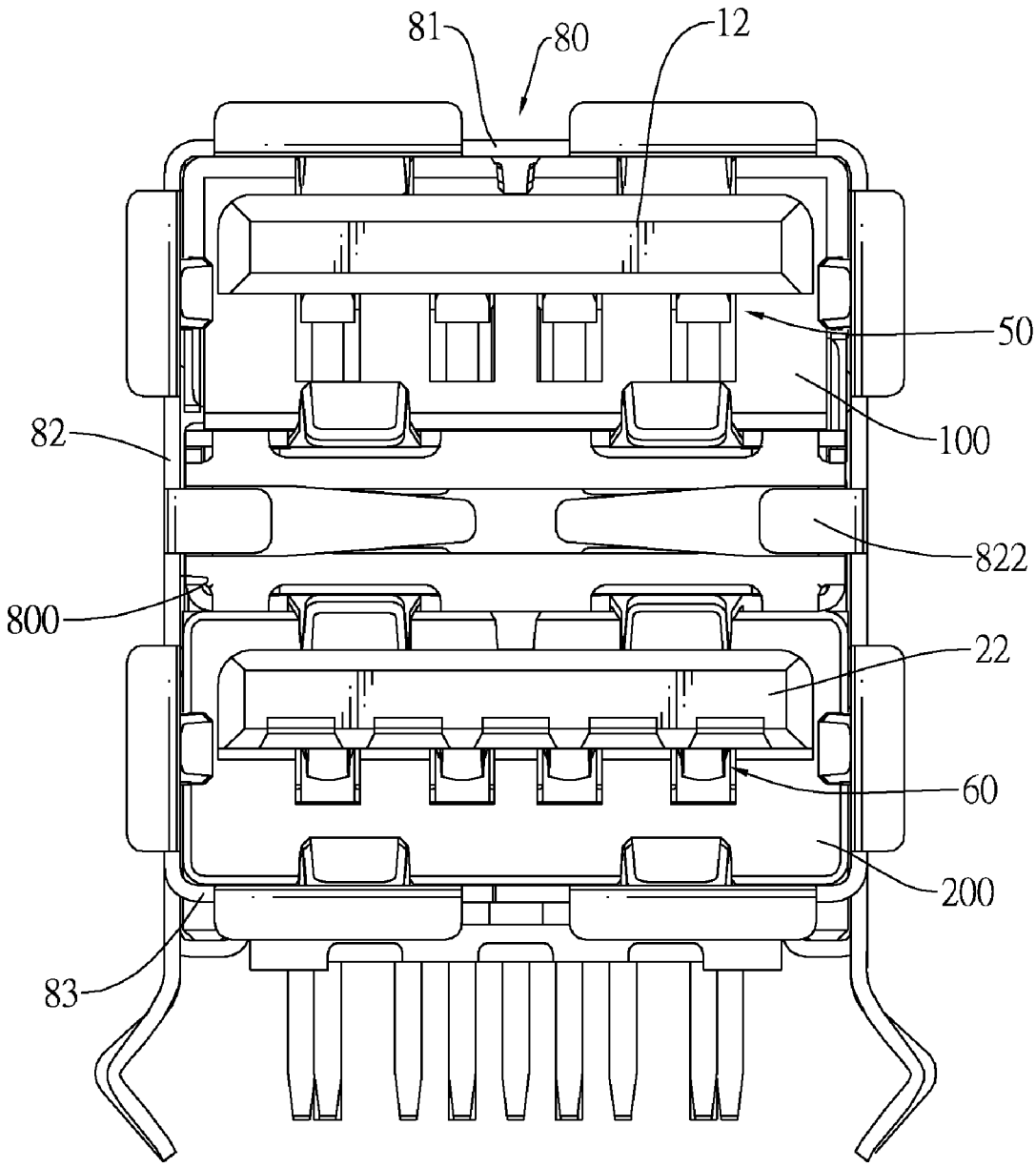
FIG. 2 is a front view of the dual socket connector in FIG. 1.
Figure 3:
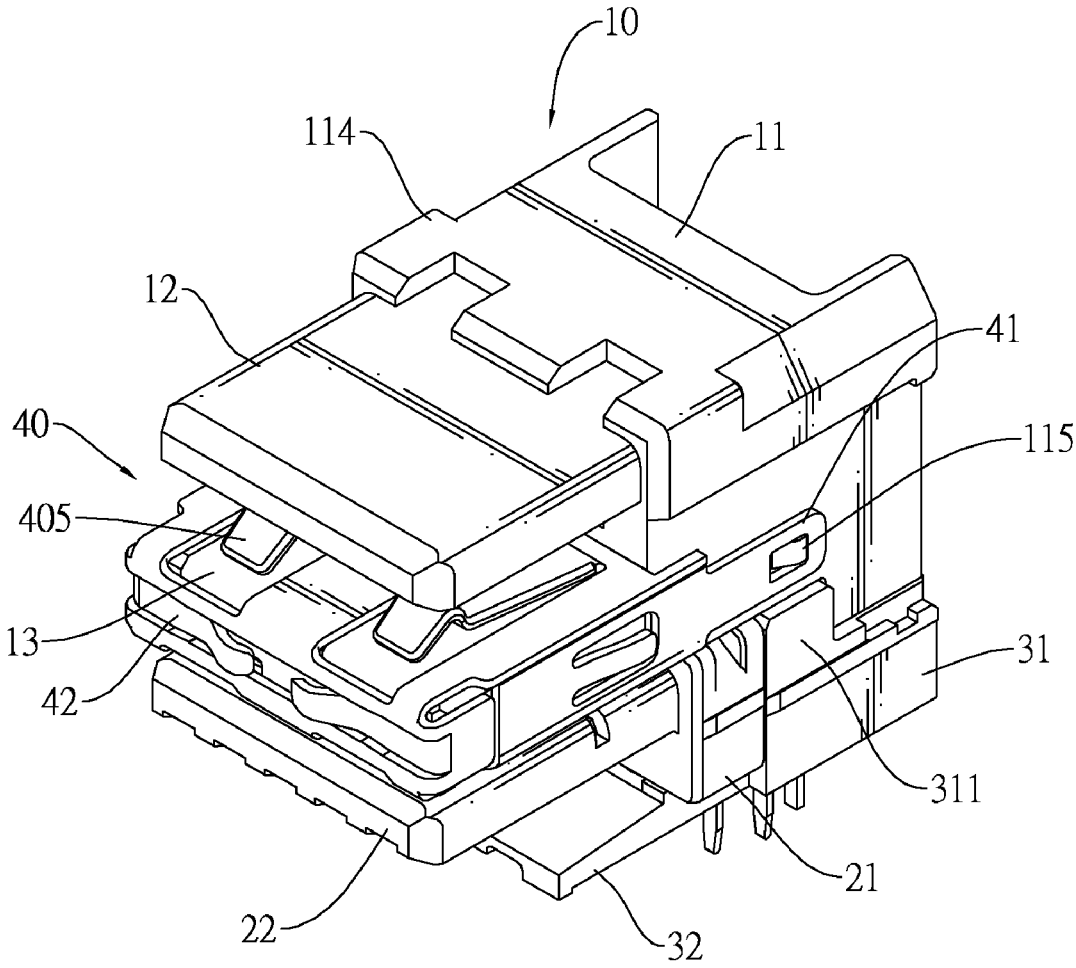
FIG. 3 is a top perspective view of the dual socket connector in FIG. 1 omitting a shell.
Figure 4:
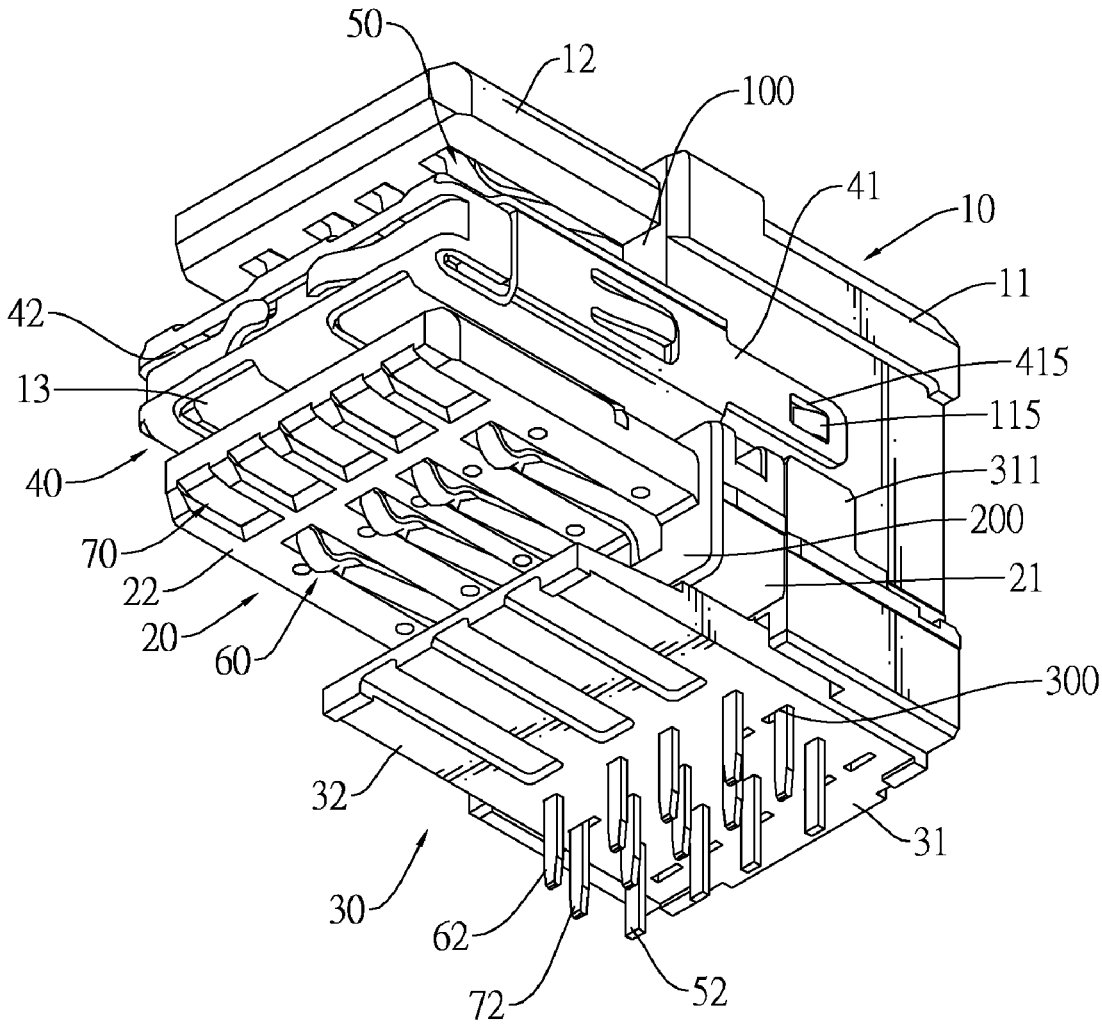
FIG. 4 is a bottom perspective view of the dual socket connector in FIG. 3.
Figure 5:
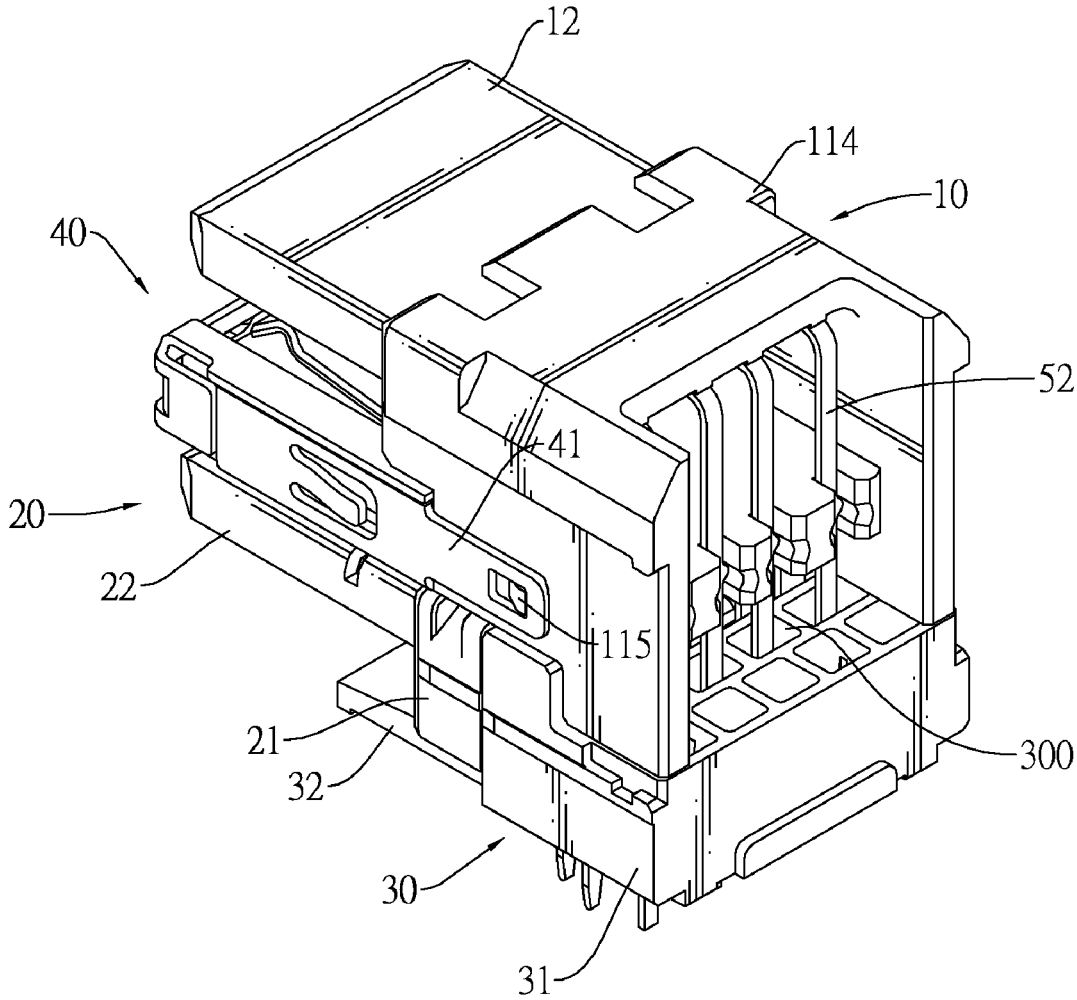
FIG. 5 is a rear perspective view of the dual socket connector in FIG. 3.
Figure 6:
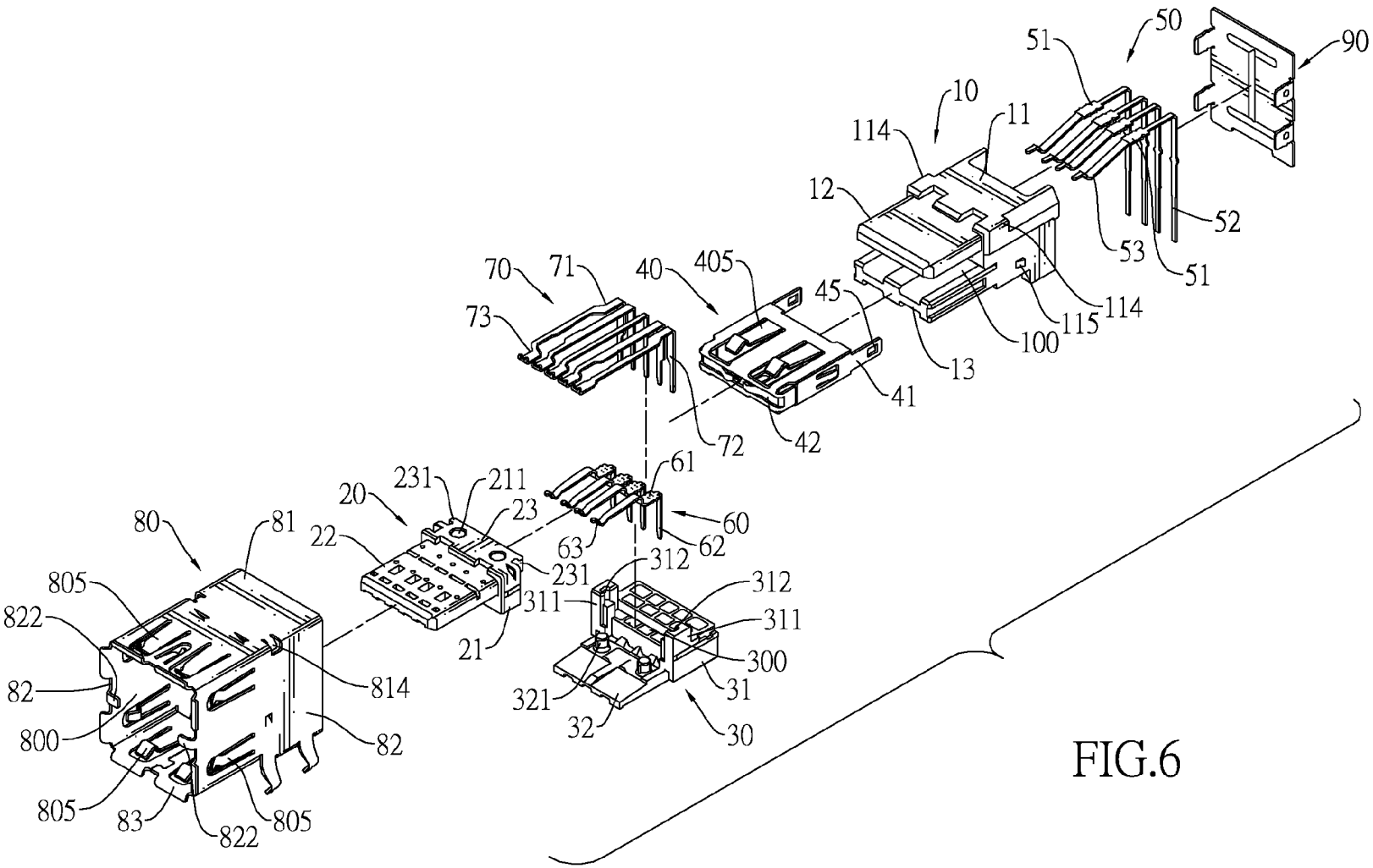
FIG. 6 is an exploded top perspective view of the dual socket connector in FIG. 1.

With reference to FIGS. 1 to 6, a dual socket connector in accordance with the present invention comprises an insulative housing assembly, multiple first terminals (50), multiple second terminals (60), multiple third terminals (70) and a shell (80) and may further have a sheath (40) and a rear sheathing plate (90).

The insulative housing assembly has a top tongue (12), a bottom tongue (22) and a partition (13) and may be assembled from a top insulative housing (10), a bottom insulative housing (20) and a positioning bracket (30).

The top tongue (12) is formed on the insulative housing assembly and has a bottom surface.

The bottom tongue (22) is formed on the insulative housing assembly under the top tongue (12) and has a bottom surface.

The partition (13) is formed on the insulative housing assembly between the top and bottom tongues (12, 22).

Figure 7:
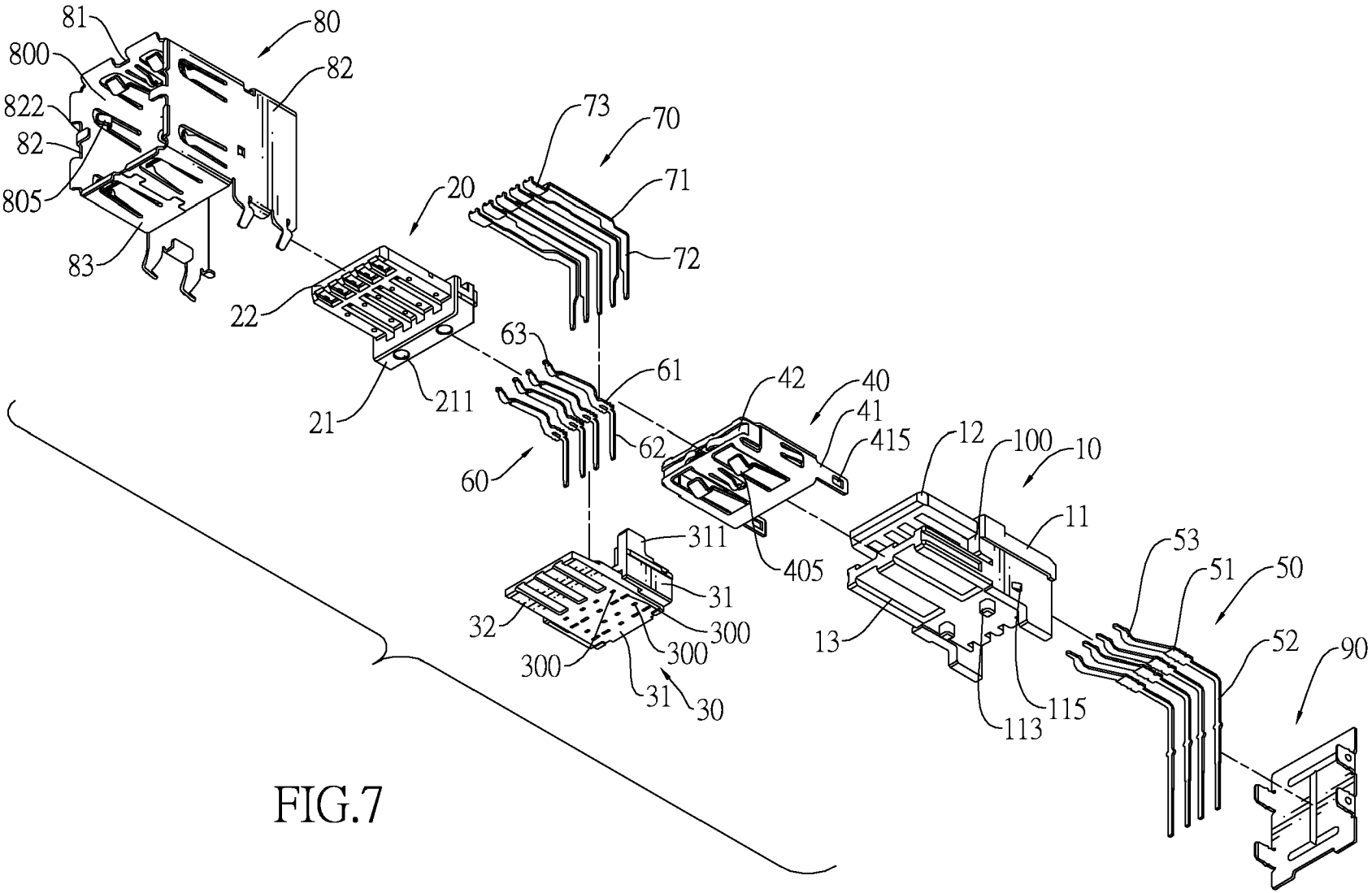
FIG. 7 is an exploded bottom perspective view of the dual socket connector in FIG. 6.
Figure 8:
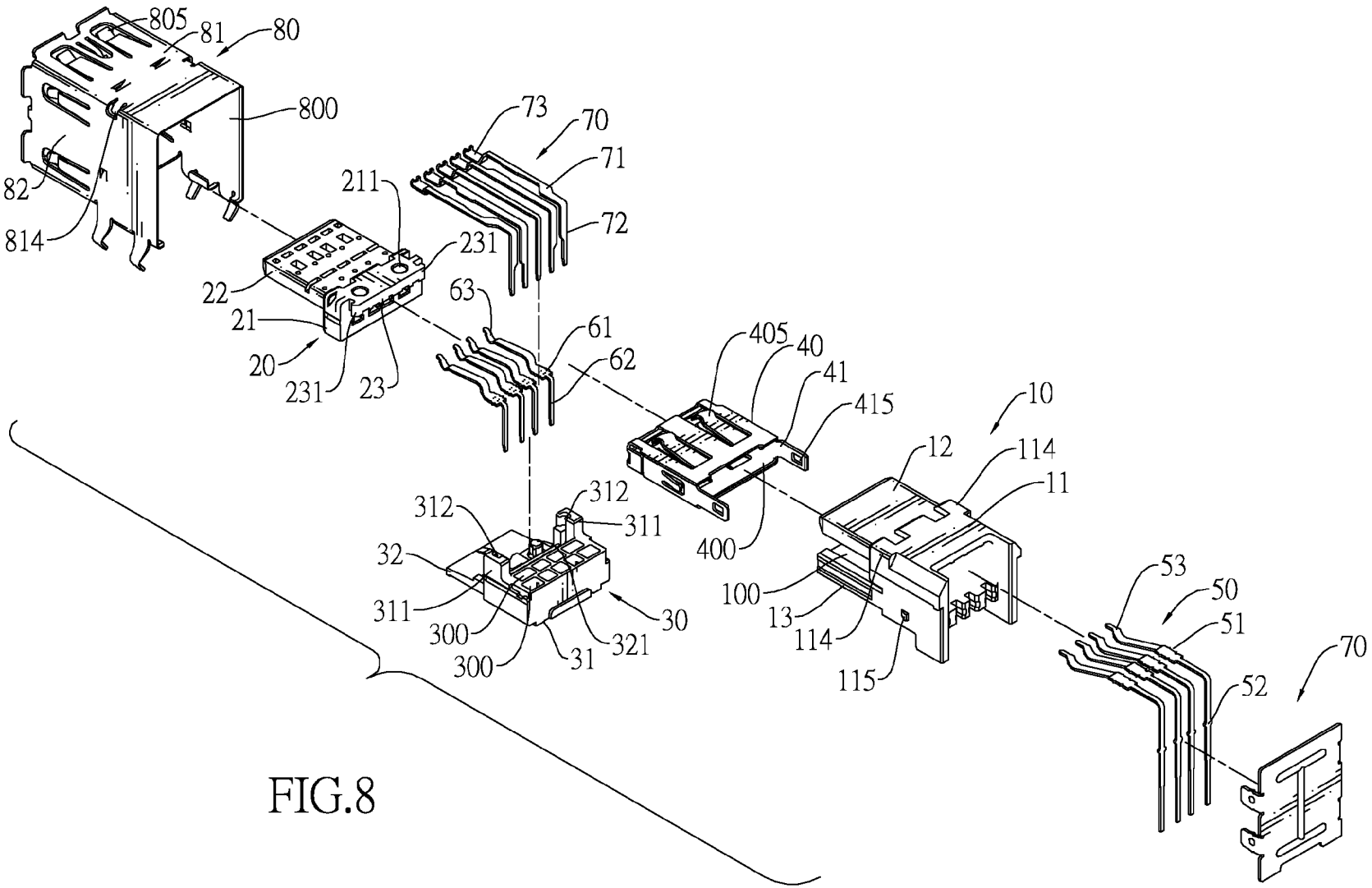
FIG. 8 is an exploded rear perspective view of the dual socket connector in FIG. 6.

With further reference to FIGS. 7 and 8, the top insulative housing (10) has the top tongue (12) and a top base (11) having a top, a bottom, a front end, a rear end, two opposite sides, multiple positioning posts (113), two stopping elements (114) and two locks (115). The top tongue (12) and partition (13) are formed on and protrude forward from the front end of the top base (11). The positioning posts (113) are formed on and protrude downward from the bottom. The stopping elements (114) are formed on and protrude transversely outward from the top base (11) respectively adjacent to the sides and each stopping element (114) has a rear end. The locks (115) are formed respectively on and protrude outward from the sides.

The bottom insulative housing (20) is mounted on the bottom of the top insulative housing (10) and has the bottom tongue (22) and a bottom base (21) having a top, a bottom, a front end, a rear end, two opposite sides, multiple positioning holes (211) and a mounting protrusion (23). The bottom tongue (22) is formed on and protrudes forward from the front end of the bottom base (21). The positioning holes (211) are defined through the bottom base (21) and each positioning hole (211) has a top opening and a bottom opening. The positioning holes (211) are mounted respectively around the positioning posts (113) by the top openings thereof. The mounting protrusion (23) is formed on and protrudes backward from the rear end of the bottom base (21) and has two slides (231). The slides (231) are formed oppositely on the mounting protrusions (23), as shown in FIG. 8.

The positioning bracket (30) is mounted under the bottom insulative housing (20) and has a mount (31) and an extension member (32).

The mount (31) has a front end, a rear end, two opposite sides and multiple through holes (300) and two opposite rails (311). The through holes (300) are defined through the mount (31). The rails (311) are formed on the mount (31) respectively adjacent to the sides and each rail (311) has a sliding slot (311) defined vertically in the rail (311) and slidably holding the slides (231) of the bottom insulative housing (20) respectively. The extension member (32) is formed on and protrudes forward from the front end of the mount (31) and has a top surface and multiple fastening posts (321). The fastening posts (321) are formed on and protrude upward from the top surface and are mounted respectively in the positioning holes (211) of the bottom base (21) through the bottom openings.

The first terminals (50) may be four, are capable of implementing USB signal transmission and are mounted on one of the top and bottom tongues (12, 22). Each first terminal (50) has a mounting section (51), a soldering section (52) and a contacting section (53). The soldering section (52) is formed on and protrudes downward from the mounting section (51) and may extend through one of the through holes (300) of the positioning bracket (30). The contacting section (53) is formed on protrudes forward from the mounting section (51).

The second terminals (60) may be four, are capable of implementing USB 2.0 signal transmission and are mounted on the other of the top and bottom tongues (12, 22). Each second terminal (60) has a mounting section (61), a soldering section (62) and a contacting section (63). The soldering section (62) is formed on and protrudes downward from the mounting section (61) and may extend through one of the through holes (300) of the positioning bracket (30). The contacting section (63) is formed on and protrudes forward from the mounting section (61).

The third terminals (70) may be five, are capable of cooperating with the second terminals (60) to implement USB 3.0 signal transmission and are mounted on one of the top and bottom tongues (12, 22) on which the second terminals (60) are also mounted. Each third terminal (70) has a mounting section (71), a soldering section (72) and a contacting section (73). The soldering section (72) is formed on and protrudes downward from the mounting section (71) and may extend through one of the through holes (300) of the positioning bracket (30). The contacting section (73) is formed on and protrudes forward from the mounting section (71).

The shell (80) covers the insulative housing assembly and the first, second and third terminals (50, 60, 70) and has a front end, a rear end, a cavity (800), a top plate (81), a bottom plate (83), two opposite side plates (82), an upper socket hole (100) and a lower socket hole (200) and may further have two stoppers (814), two hooks (822) and multiple compressing tabs (805).

The cavity (800) is defined through the shell (80).

The side plates (82) are formed between the top and bottom plates (81, 83).

The upper socket hole (100) is defined in the cavity (800) between the top plate (81) and the partition (13).

The lower socket hole (200) is defined in the cavity (800) between the partition (13) and the bottom plate (83).

The stoppers (814) are formed on the top plate (81), protrude in the cavity (800) and respectively abut the rear ends of the stoppers (114) of the top insulative housing (10) to prevent the shell (80) from inadvertently slipping on the insulative housing assembly.

The hooks (822) are formed respectively on the sides at the front end and protrude transversely inward.

The compressing tabs (805) are formed on the shell (80) and protrude inward to the cavity (800) to tightly abut a corresponding plug connector engaging the dual socket connector.

The sheath (40) may be metal, is mounted around the partition (13) and has a front end, a rear end, a mounting hole (400), a hooking slot (42), two opposite locking tabs (41) and multiple compressing tabs (405).

The mounting hole (400) is defined in the rear end of the sheath (40) and holds the partition (13).

The hooking slot (42) is defined in the front end of the sheath (40) and engages the hooks (822) of the shell (80) to prevent the shell (80) from inadvertently moving on the insulative housing assembly.

The locking tabs (41) are formed on and protrude backward from the rear end of the sheath (40) and each locking tab (41) has a locking hole (415) defined through the locking tab (41) and engaging one lock (115) of the top insulative housing (10).

The compressing tabs (405) are formed on the sheath (40) and may tightly abut a tongue of a corresponding plug connector.

The rear cover plate (90) is mounted on the rear end of the top insulative housing (10) and the positioning bracket (30) and covers the soldering sections (52, 62, 72) of the first, second and third terminals (50, 60, 70) to prevent electromagnetic interference and crosstalk.

In a first embodiment of the dual socket connector in accordance with the present invention as shown in FIGS. 1 to 8, the first terminals (50) are mounted on the top insulative housing (10), and each first terminal (50) has the mounting section (51) mounted in the top base (11), the contacting section (53) mounted on the bottom surface of the top tongue (12) and the soldering section (52) extending out of the rear end of the top base (11). The second terminals (60) are mounted on the bottom insulative housing (20) and each second terminal (60) has the mounting section (61) mounted in the bottom base (21), the contacting section (63) mounted on the bottom surface of the bottom tongue (22) and the soldering section (62) extending out of the rear end of the bottom base (21). The third terminals (70) are mounted on the bottom insulative housing (20) and each third terminal (70) has the mounting section (71) mounted in the bottom base (21), the contacting section (73) mounted on the bottom surface of the bottom tongue (22) and the soldering section (72) extending out of the rear end of the bottom base (21).

Figure 9:
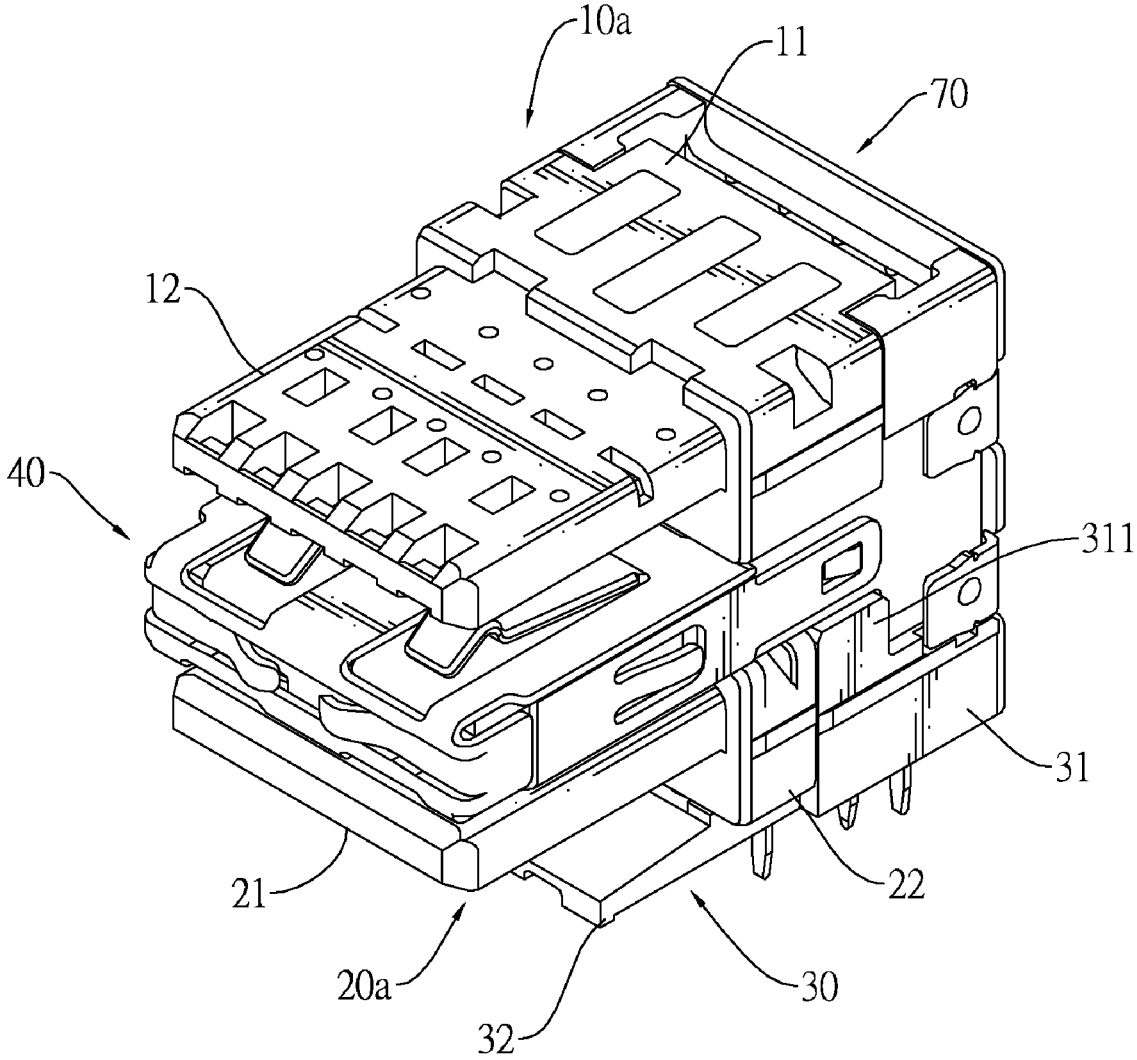
FIG. 9 is a top perspective view of a second embodiment of a dual socket connector in accordance with the present invention.
Figure 10:
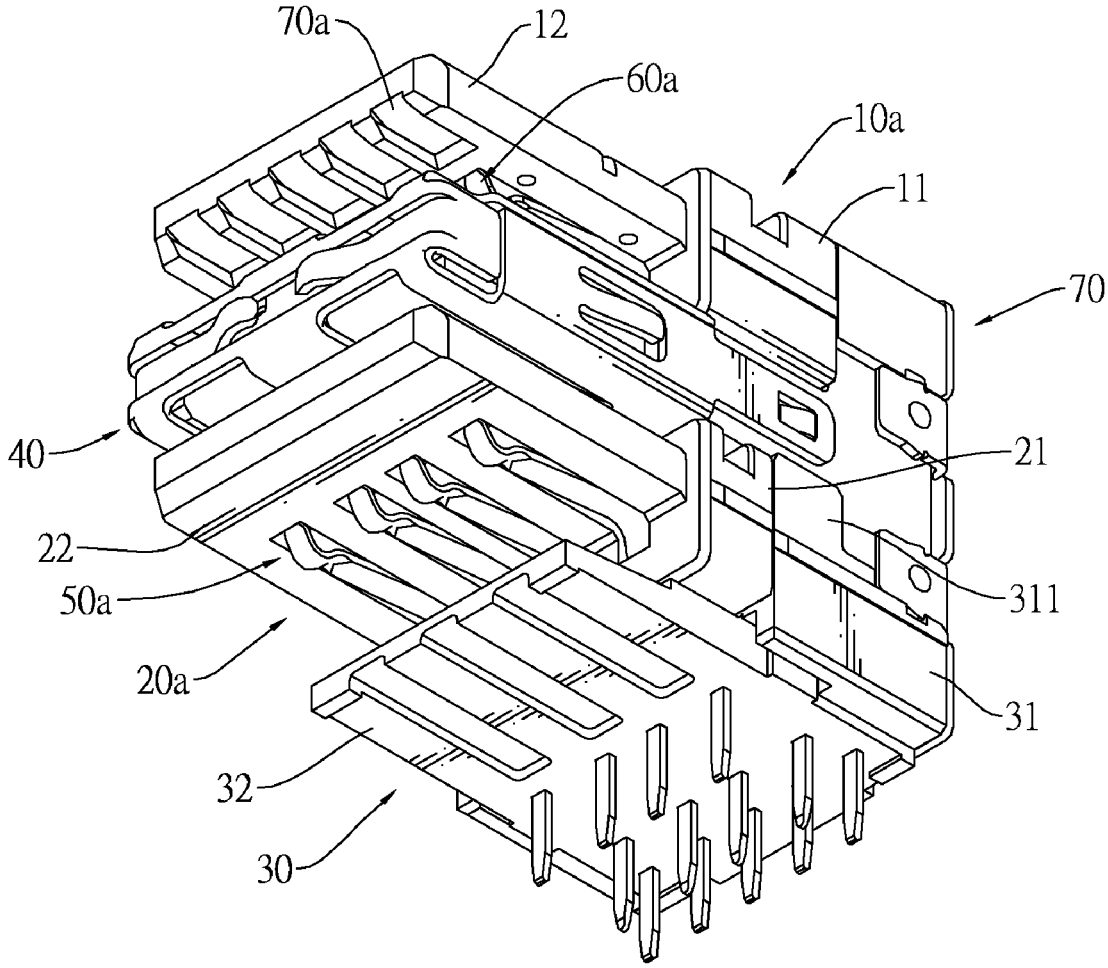
FIG. 10 is a bottom perspective of the dual socket connector in FIG. 9.

With reference to FIGS. 9 and 10, a second embodiment of the dual socket connector in accordance with the present invention has the first terminals (50*a*) mounted on the bottom insulative housing (20*a*). Each first terminal (50*a*) has the mounting section (51) mounted in the bottom base (21), the contacting section (53) mounted on the bottom surface of the bottom tongue (22) and the soldering section (52) extending out of the rear end of the bottom base (21). The second terminals (60*a*) are mounted on the top insulative housing (10*a*) and each second terminal (60*a*) has the mounting section (61) mounted in the top base (11), the contacting section (63) mounted on the bottom surface of the top tongue (12) and the soldering section (62) extending out of the rear end of the top base (11). The third terminals (70*a*) are mounted on the top insulative housing (10*a*) and each third terminal (70*a*) has the mounting section (71) mounted in the top base (11), the contacting section (73) mounted on the bottom surface of the top tongue (12) and the soldering section (72) extending out of the rear end of the top base (11).

The dual socket connector with the upper and lower socket holes (100, 200) capable of simultaneously holding a USB 2.0 plug connector and a USB 3.0 plug connector or alternatively holding both USB 2.0 plug connectors has high applicability and compatibility when compared to conventional socket connectors. Furthermore, the upper and lower socket holes (100, 200) are stacked vertically to allow the dual the socket connector to only occupy an equivalent surface area as a conventional socket connector when mounted on a PCB. Thus the dual socket connector is light and compact while having high compatibility.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A dual socket connector comprising:

an insulative housing assembly having a top tongue formed on the insulative housing assembly and having a bottom surface;

a bottom tongue formed on the insulative housing assembly under the top tongue and having a bottom surface; and a partition formed on the insulative housing assembly between the top and bottom tongues;

multiple first terminals mounted on one of the top and bottom tongues and capable of implementing USB 2.0 signal transmission;

multiple second terminals mounted on the other of the top and bottom tongues and capable of implementing USB 2.0 signal transmission;

multiple third terminals mounted on one of the top and bottom tongues on which the second terminals are also mounted wherein the third terminals are capable of cooperating with the second terminals to implement USB 3.0 signal transmission; and a conductive shell covering the insulative housing assembly and the first, second and third terminals, having a front end, a rear end, a cavity, a top plate, a bottom plate and two opposite side plates and further having an upper socket hole defined in the cavity between the top plate and the partition and a lower socket hole in the cavity between the partition and the bottom plate;

wherein the insulative housing is assembled by a top insulative housing and a bottom insulative housing; the top insulative housing has a top base having a top, a bottom, a front end, a rear end and two opposite sides and the top tongue is formed thereon and protrudes forward from the front end of the top base; and the bottom insulative housing has a bottom base having a top, a bottom, a front end, a rear end and two opposite sides and the bottom tongue is formed thereon and protrudes forward from the front end of the bottom base;

wherein each first terminal has a mounting section, a soldering section formed and protruding downward from the mounting section and a contacting section formed on and protruding forward from the mounting section; each second terminal has a mounting section, a soldering section formed and protruding downward from the mounting section and a contacting section formed on and protruding forward from the mounting section; and each third terminal has a mounting section, a soldering section formed and protruding downward from the mounting section and a contacting section formed on and protruding forward from the mounting section;

wherein a positioning bracket is mounted under the bottom insulative housing and has a mount having a front end, a rear end, two opposite sides and multiple through holes defined through the mount so that each soldering section of the first, second and third terminals extends through one of the through holes; and an extension member formed on and protruding forward from the front end of the mount and having a top surface and multiple fastening posts formed on and protruding upward from the top surface and mounted respectively in the positioning holes of the bottom base through the bottom openings; and wherein the bottom base of the bottom insulative housing further has a mounting protrusion formed thereon and protruding backward from the rear end of the bottom base and having two slides formed oppositely on the mounting protrusion; and the mount of the positioning bracket further has two opposite rails formed on the mount respectively adjacent to the sides and each rail having a vertical sliding slot therein and slidably holding the slides of the bottom insulative housing respectively.

2. The dual socket connector as claimed in claim 1, wherein the top base further has multiple positioning posts formed on and protruding downward from the bottom of the top base; and the bottom base further has multiple positioning holes defined through the bottom base, each positioning hole has a top opening and a bottom opening, and the positioning holes are mounted respectively around the positioning posts by the top openings.

3. The dual socket connector as claimed in claim 1, wherein the partition is formed on and protrudes forward from the front end of the top base of the insulative housing.

4. The dual socket connector as claimed in claim 1 further comprising a conductive sheath mounted around the partition and having a front end, a rear end and a mounting hole defined in the rear end of the sheath and holding the partition.

5. The dual socket connector as claimed in claim 4, wherein the top base of the top insulative housing further has two stopping elements formed thereon and protruding transversely outward from the top base respectively adjacent to the sides and each stopping element having a rear end;

the sheath has a hooking slot defined in the front end of the sheath; and the shell has two stoppers formed on the top plate, protruding in the cavity and respectively abutting the rear ends of the stoppers of the top insulative housing; and two hooks formed respectively on the sides at the front end and protruding transversely inward and engaging the hooking slot of the sheath.

6. The dual socket connector as claimed in claim 4, wherein the top base of the top insulative housing further has two locks formed respectively on and protruding outward from the sides; and the sheath further has two opposite locking tabs formed on and protruding backward from the rear end of the sheath and each locking tab having a locking hole defined through the locking tab and engaging one lock of the top insulative housing.

7. The dual socket connector as claimed in claim 4, wherein the shell further has multiple compressing tabs formed on the shell and protruding inward to the cavity; and the sheath further has multiple compressing tabs formed on the sheath.

8. The dual socket connector as claimed in claim 1 further comprising a rear cover plate mounted on the rear end of the top insulative housing and the positioning bracket and covering the soldering sections of the first, second and third terminals.

9. The dual socket connector as claimed in claim 1, wherein the first terminals are mounted on the top insulative housing and each first terminal has the mounting section mounted in the top base, the contacting section mounted on the bottom surface of the top tongue and the soldering section extending out of the rear end of the top base;

the second terminals are mounted on the bottom insulative housing and each second terminal has the mounting section mounted in the bottom base, the contacting section mounted on the bottom surface of the bottom tongue and the soldering section extending out of the rear end of the bottom base; and the third terminals are mounted on the bottom insulative housing and each third terminal has the mounting section mounted in the bottom base (21), the contacting section mounted on the bottom surface of the bottom tongue and the soldering section extending out of the rear end of the bottom base.

10. A dual socket connector comprising:

an insulative housing assembly having a top tongue formed on the insulative housing assembly and having a bottom surface;

a bottom tongue formed on the insulative housing assembly under the top tongue and having a bottom surface; and a partition formed on the insulative housing assembly between the top and bottom tongues;

multiple first terminals mounted on one of the top and bottom tongues and capable of implementing USB 2.0 signal transmission;

multiple second terminals mounted on the other of the top and bottom tongues and capable of implementing USB 2.0 signal transmission;

multiple third terminals mounted on one of the top and bottom tongues on which the second terminals are also mounted, wherein the third terminals are capable of cooperating with the second terminals to implement USB 3.0 signal transmission; and a conductive shell covering the insulative housing assembly and the first, second and third terminals, having a front end, a rear end, a cavity, a top plate, a bottom plate and two opposite side plates and further having an upper socket hole defined in the cavity between the top plate and the partition and a lower socket hole in the cavity between the partition and the bottom plate;

wherein the insulative housing is assembled by a top insulative housing and a bottom insulative housing; the top insulative housing has a top base having a top, a bottom, a front end, a rear end and two opposite sides and the top tongue is formed thereon and protrudes forward from the front end of the top base; and the bottom insulative housing has a bottom base having a top, a bottom, a front end, a rear end and two opposite sides and the bottom tongue is formed thereon and protrudes forward from the front end of the bottom base;

wherein a conductive sheath is mounted around the partition and has a front end, a rear end and a mounting hole defined in the rear end of the sheath and holding the partition; and wherein the top base of the top insulative housing further has two stopping elements formed thereon and protruding transversely outward from the top base respectively adjacent to the sides and each stopping element having a rear end; the sheath has a hooking slot defined in the front end of the sheath; and the shell has two stoppers formed on the top plate, protruding in the cavity and respectively abutting the rear ends of the stoppers of the top insulative housing; and two hooks formed respectively on the sides at the front end and protruding transversely inward and engaging the hooking slot of the sheath.

11. The dual socket connector as claimed in claim 10, wherein the top base further has multiple positioning posts formed on and protruding downward from the bottom of the top base; and the bottom base further has multiple positioning holes defined through the bottom base, each positioning hole has a top opening and a bottom opening, and the positioning holes are mounted respectively around the positioning posts by the top openings.

12. The dual socket connector as claimed in claim 10, wherein the partition is formed on and protrudes forward from the front end of the top base of the insulative housing.

13. The dual socket connector as claimed in claim 10, wherein the top base of the top insulative housing further has two locks formed respectively on and protruding outward from the sides; and the sheath further has two opposite locking tabs formed on and protruding backward from the rear end of the sheath and each locking tab having a locking hole defined through the locking tab and engaging one lock of the top insulative housing.

14. The dual socket connector as claimed in claim 10, wherein the shell further has multiple compressing tabs formed on the shell and protruding inward to the cavity; and the sheath further has multiple compressing tabs formed on the sheath.

* * * * *